US009200849B2

(12) United States Patent
Jeon et al.

(10) Patent No.: US 9,200,849 B2
(45) **Date of Patent: *Dec. 1, 2015**

(54) EVAPORATOR

(71) Applicant: HALLA CLIMATE CONTROL CORP., Daejeon (KR)

(72) Inventors: Young-Ha Jeon, Daejeon (KR); Jun Young Song, Daejeon (KR); Hong-Young Lim, Daejeon (KR); Jung Sam Gu, Daejeon (KR); Kwang Hun Oh, Daejeon (KR)

(73) Assignee: Halla Visteon Climate Control Corp., Daejeon (KR)

( * ) Notice: Subject to any disclaimer, the term of this patent is extended or adjusted under 35 U.S.C. 154(b) by 240 days.

This patent is subject to a terminal disclaimer.

(21) Appl. No.: 13/874,203

(22) Filed: Apr. 30, 2013

(65) Prior Publication Data

US 2013/0312455 A1 Nov. 28, 2013

(30) Foreign Application Priority Data

May 22, 2012 (KR) ..... 10-2012-0054057

(51) Int. Cl.

| | |
|---|---|
| ***F25B 39/02*** | (2006.01) |
| ***F28F 9/26*** | (2006.01) |
| ***F28D 1/04*** | (2006.01) |
| ***F28F 9/02*** | (2006.01) |
| ***F28D 1/053*** | (2006.01) |
| *F28D 21/00* | (2006.01) |

(52) U.S. Cl.

CPC ..... *F28D 1/0435* (2013.01); *F25B 39/028* (2013.01); *F28D 1/05391* (2013.01); *F28F 9/0204* (2013.01); *F28F 9/0224* (2013.01); *F28F 9/26* (2013.01); *F28D 2021/0085* (2013.01); *F28F 2275/143* (2013.01)

(58) Field of Classification Search

CPC .... F25B 39/028; F25B 9/0207; F25B 9/0246; F25B 9/0212; F25B 9/26; F28D 1/0435; F28D 1/0417; F28D 1/05341; F28D 2021/0085

USPC ..... 62/524, 515, 509; 165/173, 175

See application file for complete search history.

(56) References Cited

U.S. PATENT DOCUMENTS

| | | | | |
|---|---|---|---|---|
| 6,871,508 | B2 * | 3/2005 | Wanami et al. | 62/196.4 |
| 2003/0177775 | A1 * | 9/2003 | Wanami et al. | 62/196.4 |
| 2005/0172664 | A1 * | 8/2005 | Cho et al. | 62/515 |
| 2005/0269066 | A1 * | 12/2005 | Horiuchi et al. | 165/153 |

(Continued)

FOREIGN PATENT DOCUMENTS

| | | | |
|---|---|---|---|
| JP | 05-096784 | U | 12/1993 |
| JP | 2000-62452 | A | 2/2000 |

(Continued)

*Primary Examiner* — Mohammad M Ali

(74) *Attorney, Agent, or Firm* — Novick, Kim & Lee, PLLC; Jae Youn Kim

(57) ABSTRACT

Provided is an evaporator including a tank formed with a depressed part and a flow part having a refrigerant flow therein using a flow part forming member, separately from a first compartment and a second compartment to improve a refrigerant channel structure, in a double evaporator in which a refrigerant flows in a first column and a second column, respectively, thereby reducing the number of four inlets and outlets that is disposed in the first column and the second column, respectively, fixing a baffle at an accurate position, and reducing a defective rate to more improve productivity.

12 Claims, 11 Drawing Sheets

(56) References Cited

U.S. PATENT DOCUMENTS

| | | | | |
|---|---|---|---|---|
| 2006/0162917 | A1* | 7/2006 | Park et al. | 165/175 |
| 2006/0201198 | A1* | 9/2006 | Nishino et al. | 62/525 |
| 2008/0099191 | A1* | 5/2008 | Taras et al. | 165/174 |
| 2008/0141707 | A1* | 6/2008 | Knight et al. | 62/498 |
| 2009/0114379 | A1* | 5/2009 | Lim et al. | 165/151 |
| 2010/0031698 | A1* | 2/2010 | Higashiyama | 62/525 |
| 2010/0071392 | A1* | 3/2010 | Taras et al. | 62/118 |
| 2010/0206535 | A1* | 8/2010 | Munoz et al. | 165/173 |
| 2011/0239696 | A1* | 10/2011 | Takagi | 62/524 |
| 2011/0315363 | A1* | 12/2011 | Matter et al. | 165/173 |

FOREIGN PATENT DOCUMENTS

| | | | |
|---|---|---|---|
| JP | 2005-308384 | A | 11/2005 |
| JP | 2012-067994 | A | 4/2012 |
| KR | 10-2004-0091577 | A | 10/2004 |
| KR | 10-2006-0009653 | A | 2/2006 |
| KR | 10-2009-0015582 | A | 2/2009 |
| KR | 10-2009-0022697 | A | 3/2009 |
| KR | 10-2009-0045852 | A | 5/2009 |
| KR | 10-2012-0010357 | A | 2/2012 |

* cited by examiner

-Prior Art-

-Prior Art-

EVAPORATOR

CROSS-REFERENCE TO RELATED APPLICATIONS

This application claims priority under 35 U.S.C. §119 to Korean Patent Application No. 10-2012-0054057, filed on May 22, 2012 in the Korean Intellectual Property Office, the disclosure of which is incorporated herein by reference in its entirety.

TECHNICAL FIELD

The following disclosure relates to an evaporator including a tank formed with a depressed part and a flow part having a refrigerant flow therein using a flow part forming member, separately from a first compartment and a second compartment to improve a refrigerant channel structure, in a double evaporator in which a refrigerant flows in a first column and a second column, respectively, thereby reducing the number of four inlets and outlets that are disposed in the first column and the second column, respectively, fixing a baffle at an accurate position, and reducing a defective rate to more improve productivity.

BACKGROUND

An air conditioner for vehicles is an interior part of a car that is installed for the purpose of cooling or heating an interior of a car during a summer season or a winter season or removing a frost formed on a windshield during rainy weather or the winter season, and the like, to allow a driver to secure a front and rear sight. The air conditioner usually includes both of the heating system and the cooling system to optionally introduce external air or internal air, heat or cool the air, and then send the air to an interior of a car, thereby cooling, heating, or ventilating the interior of a car.

A general refrigerating cycle of the air conditioner includes an evaporator that absorbs heat from a surrounding area, a compressor that compresses a refrigerant, a condenser that discharges heat to the surrounding area, an expansion valve that expanding the refrigerator. In the cooling system, the refrigerator in a gaseous state that is introduced into the compressor from the evaporator is compressed at high temperature and high pressure by the compressor, liquefaction heat is discharged to the surrounding area while the compressed refrigerant in a gaseous state is liquefied by passing through the condenser, the liquefied refrigerant is in a low-temperature and low-pressure wet saturated steam state by again passing through the expansion valve, and is again introduced into the evaporator and vaporized to absorb vaporization heat and cool the surrounding air, thereby cooling the interior of a car.

Numerous researches for allowing representative heat exchangers, such as a condenser, an evaporator, and the like, that are used in the cooling system to more effectively exchange heat between air outside the heat exchanger and a heat exchange medium in the heat exchanger, that is, a refrigerant, have been steadily conducted. The most direct effect in cooling the interior of a car is shown in an evaporator efficiency. In particular, various structural researches and developments for improving a heat exchange efficiency of the evaporator have been conducted.

As one of the improved structures to increase the heat exchange efficiency of the evaporator, a double evaporation structure, in which a core including a tube and a pin doubly forms a first column and a second column that are a space in which a refrigerant flows individually, is proposed as an example.

As the related art, Japanese Patent Laid-Open Publication No. 2000-062452 ("Air conditioner for vehicles, Feb. 29, 2000), Japanese Patent Laid-Open Publication No. 2005-308384 ("Ejector cycle, Nov. 4, 2005), and the like, disclose a form similar to a double evaporator in which a refrigerant independently flows in the first column and the second column, respectively.

Meanwhile, an example of the evaporator having the double evaporation structure is illustrated in FIGS. 1 and 2. (FIG. 1 is a perspective view of the evaporator and FIG. 2 is a schematic diagram of a flow within the first column and the second column of the evaporator illustrated in FIG. 1).

An evaporator 1 illustrated in FIGS. 1 and 2 is configured to form a first header tank 11 and a second header tank 12 formed in parallel with each other, being spaced apart from each other by a predetermined distance and including at least one baffle 13 that is partitioned by a barrier rib to form a first column and a second column to partition each of the first compartment and the second compartment in a width direction and partition a space in a length direction; a first inlet 41 that is connected with one portion of the first compartment of the first header tank 11 to introduce a flowing refrigerant into the first column and a first outlet 42 that is connected with the other portion of the first compartment of the first header tank 11 to discharge the refrigerant; a second inlet 43 that is connected with the other portion of the second compartment of the first header tank 11 to introduce a flowing refrigerant into the second column and a second outlet that is connected with one portion of the second compartment of the second header tank 12 to discharge the refrigerant; a plurality of tubes 20 of which both ends are fixed to the first header tank 11 and the second header tank 12; and a pin 30 interposed between the tubes 20.

Referring to FIG. 2, in the first column of the evaporator 1, a refrigerant is introduced into the first compartment of the first header tank 11 through the first inlet 41 to move to the first compartment of the second header tank 12 through a tube 20 and again move to the first compartment of the first header tank 11 through the remaining tubes 20 and then is discharged through the first outlet 42.

In addition, in the second column, a refrigerant is introduced into the second compartment of the first header tank 11 through the second inlet 43 to move to the second compartment of the second header tank 12 through a tube 20 and again the second compartment of the first header tank 11 through the remaining tubes 20 and is discharged through the second outlet.

In other words, in the evaporator 1 illustrated in FIGS. 1 and 2, the refrigerants of the first column and the second column flow individually. To this end, two inlets 41 and 43 and two outlets 42 and 44 for introducing and discharging the refrigerant into and from the first column and the second column must be provided.

Therefore, in the evaporator having the double evaporation structure with four pipes forming the inlets and the outlets need to be connected with one another, and therefore manufacturing costs for manufacturing and fixing them would increase. In particular, as illustrated in FIG. 1, in case of using a separate pipe fixing part for connecting and fixing the four pipes, the foregoing problem would be more serious.

Further, in the evaporator having the double evaporation structure with the pipe itself takes up a lot of interior space of an engine room to hinder the miniaturization of the evaporator and reduce a heat exchange region as much, thereby degrading the cooling performance.

Therefore, a need exists for a development of an evaporator having high heat exchange efficiency, high manufacturing performance, and miniaturization.

RELATED ART DOCUMENT

Patent Document

Patent Document 1) Japanese Patent Laid-Open Publication No. 2000-062452 ("Air conditioner for vehicles", Feb. 29, 2000)

Patent Document 2) Japanese Patent Laid-Open Publication No. 2005-308384 ("Ejector cycle", Nov. 4, 2005)

SUMMARY

An exemplary embodiment of the present invention is directed to providing an evaporator with the improved refrigerant channel structure using a flow part in a double evaporator in which a refrigerant independently flows in a first column and a second column, respectively, to solve a problem of degradation of productivity and difficulty of miniaturization due to an increase in the number of inlets and outlets.

In one general aspect, there is provided an evaporator 1000, including: a first header tank and a second header tank formed in parallel with each other, being spaced apart from each other by a predetermined distance and including at least one baffle that is partitioned by a barrier rib 11 to form a first column and a second column to partition each of the first compartments 100*a* and the second compartments 200*a* in a width direction and partition a space in a length direction; and plurality of tubes of which both ends are fixed to the first header tank 100 and the second header tank 200; and a pin 300 interposed between the tubes 300, wherein in the first header tank 100 is formed by a coupling of a header 110 and a tank 120 in which the depressed part 121 of which the central region formed with the barrier rib 111 in a width direction is depressed is lengthily formed in a length direction and includes a flow part forming member 140 that is provided to cover the depressed part 121 of the tank 120 and has the flow part 100*c* disposed therein to have a refrigerant flow therein, separately from the first compartment 100*a* and the second compartment 100*b*.

In the first header tank 100, the central region of the depressed part at which the barrier rib 111 is disposed may be provided with a first fixed groove 124 of which the predetermined region is hollowed in a width direction, and the baffle 130 may be integrally formed in a width direction to partition the first compartment 100*a* and the second compartment 100*b* in a length direction and a first protruded part 131 inserted into the first fixed groove 124 may be protruded.

In the first header tank 100, a pair of second fixed grooves 125, in which a predetermined region of the tank 120 forming the first compartment 100*a* and the second compartment 100*b*, respectively, is hollowed in a width direction, may be provided, and the baffle 130 may be provided with second protruded parts 132 that are inserted into the pair of second fixed grooves 125, respectively.

The first header tank 100 may be provided with the pair of second fixed grooves 125 to have different lengths in a width direction.

In the first header tank 100, a predetermined region of the second protruded part 132 of the baffle 130 may extend in a lateral direction and a temporarily assembled part 133 keeping a state, in which the flow part forming member 140 is temporarily assembled, may be provided.

In the first header tank 100, the depressed part 121 may be further provided with a pair of guide parts 126 protruded to the first compartment 100*a* or the second compartment 100*b* to support the baffle 130.

The tank 120 of the first header tank 100 may be inclined to the barrier rib 111 so that the depressed part 121 has a "Y"-letter shape along with the barrier rib 111.

Both ends of the first header tank 100 may be provided with an end cap 150 including a plate part 151 and a support part 151*a* that is protruded in a form in which a predetermined region of the plate part 151 corresponds to a space of the flow part 100*c* to support the flow part forming member 140.

One of the end caps 150 disposed at both ends of the first header tank 100 may be provided with a first hollow hole 152 of which the predetermined region corresponding to the first compartment 100*a* in a predetermined region of the plate part 151 is hollowed, and a second hollow hole 153 of which the predetermined region corresponding to the second compartment 100*b* in the predetermined region of the plate part 151 is hollowed, and the other one of the end caps 150 may be provided with a third hollow hole 154 of which the predetermined region corresponding to the first compartment 100*a* in the predetermined region of the plate part 151 is hollowed.

The first header tank 100 may be provided with a first inlet 510 connected with one portion of the first compartment 100*a* to introduce a refrigerant; an outlet 520 connected with the other portion of the first compartment 100*a* to discharge the refrigerant; and a second inlet 530 connected with the other portion of the second compartment 100*b* to introduce the refrigerant.

In the tank 120 of the first header tank 100, the depressed part 121 may be provided with a first communication hole 122 that is adjacent to a formation region of the first inlet 510 in a length direction to communicate the second compartment 100*b* with the flow part 100*c* and a second communication hole 123 that is adjacent to a formation region of the outlet 520 and the second inlet 530 in a length direction to communicate the first compartment 100*a* with the flow part 100*c*.

The evaporator 1000 may further include: in the first column, a 1-1-th region that the refrigerant introduced into the first compartment 100*a* of the first header tank 100 through the first inlet 510 moves to the first compartment 200*a* of the second header tank 200 through the tube 300 and a 1-2-th region in which the refrigerant of the first compartment 200*a* of the second header tank 200 moves to the first compartment 100*a* of the first header tank 100 through the tube 300; and in a second column, a 2-1-th region in which the refrigerant introduced into the second compartment 100*b* of the first header tank 100 through the second inlet 530 moves to the second compartment 200*b* of the second header tank 200 through the tube 300 and a 2-2-th region A2-2 in which the refrigerant of the second compartment 200*b* of the second header tank 200 moves to the second compartment 100*b* of the first header tank 100 through the tube 300, and wherein the refrigerant passing through both of the 2-1-th region A2-1 and the 2-2-th region A2-2 of the second column moves to the flow part 100*c* through the first communication hole 122 and moves in a length direction and is joined with the refrigerant discharged through the 1-1-th region A1-1 and the 1-2-th region A1-2 of the first column through the second communication hole 123 to be discharged through the outlet 520.

[Detailed Description of Main Elements]

Figure 1:
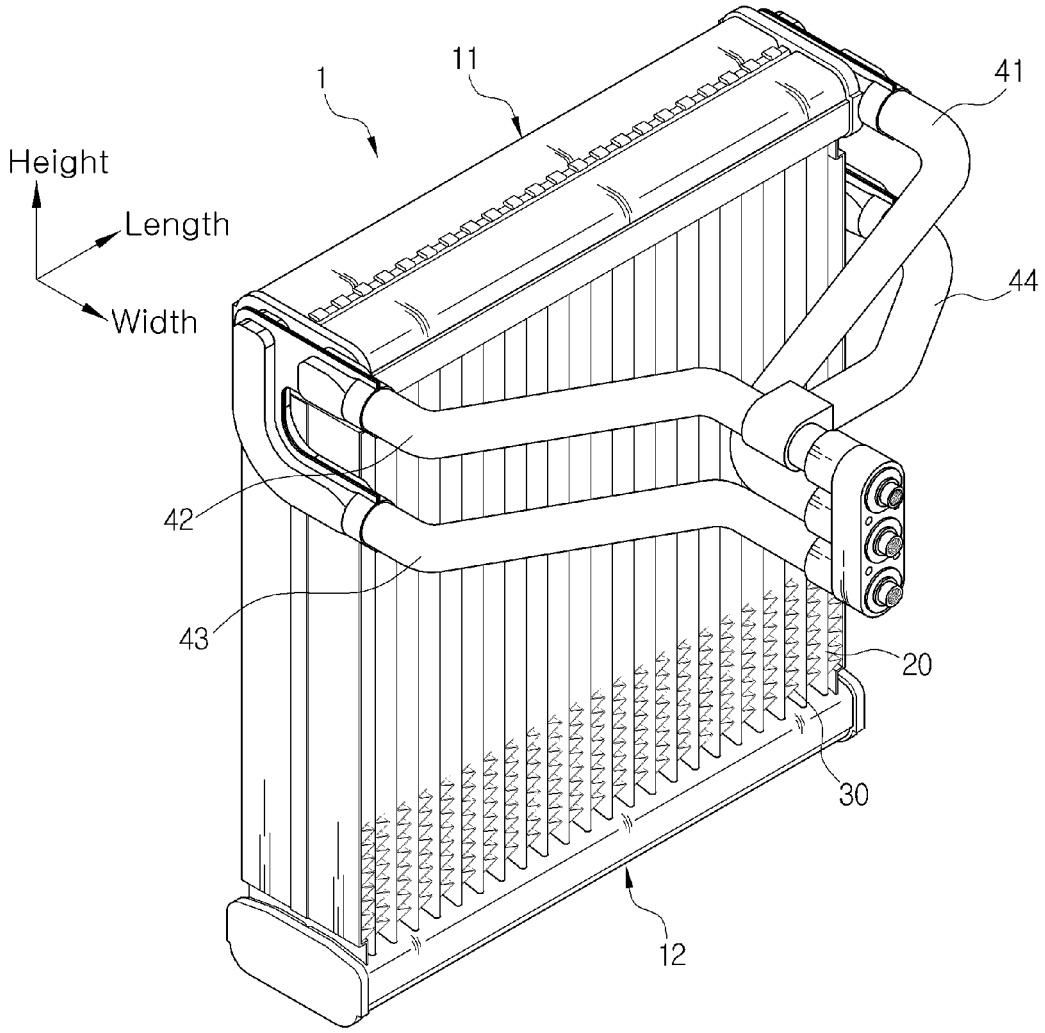
FIG. 1 is a perspective view illustrating an evaporator having a double evaporation structure according to the related art.
Figure 2:
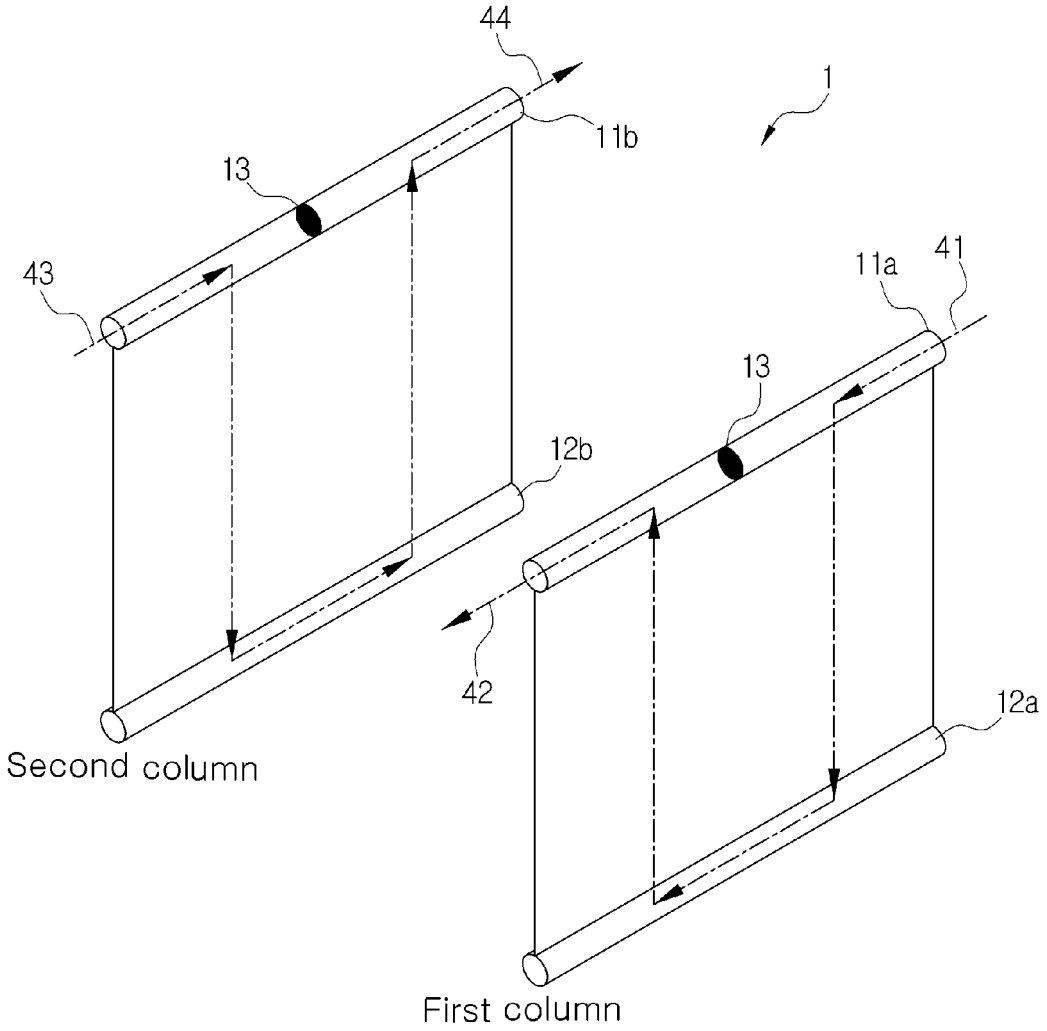
FIG. 2 is a schematic view illustrating a refrigerator flow within the evaporator illustrated in FIG. 1.
Figure 3:
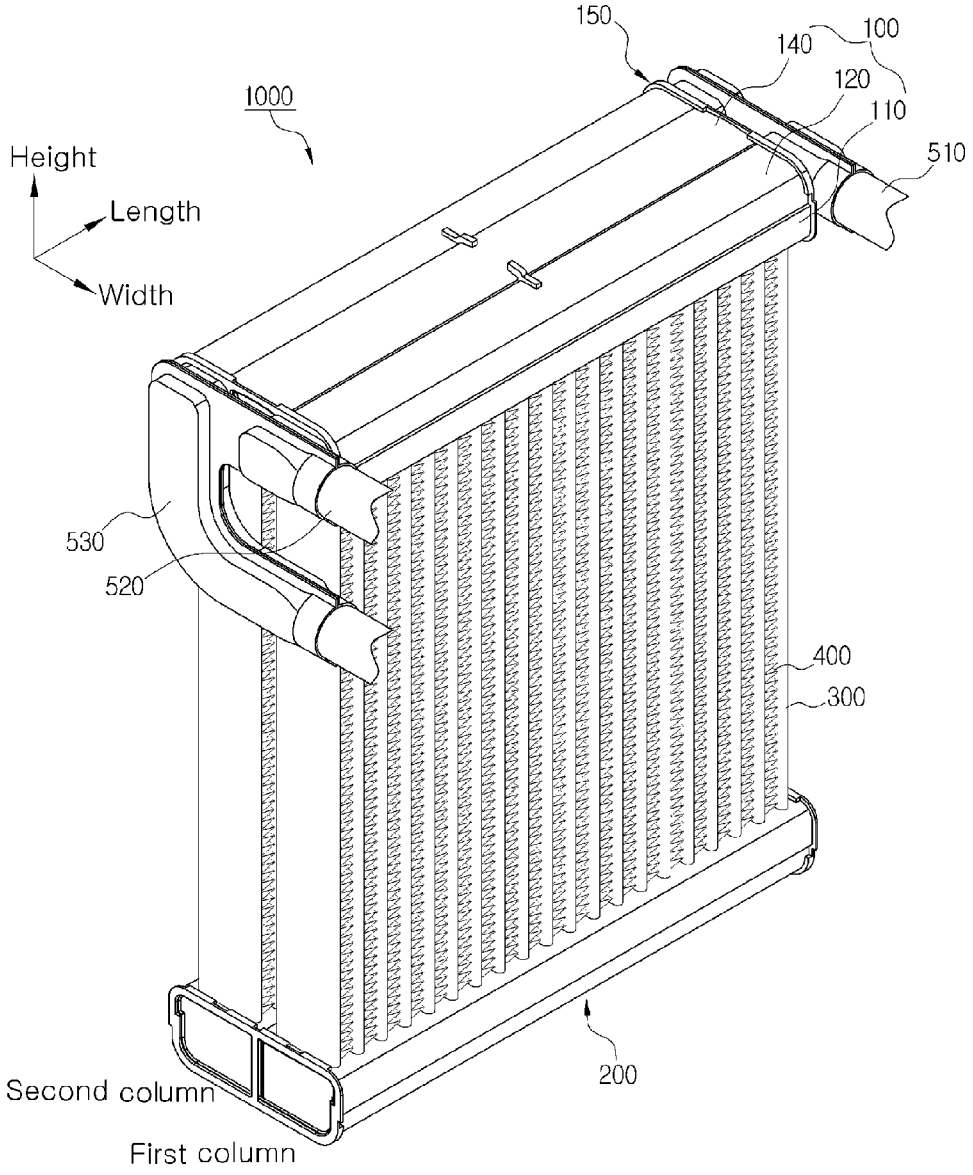
FIGS. 3 to 5B are a perspective view of an evaporator according to the present invention, an exploded perspective view and a cross-sectional view of a first header tank, respectively.

| | |
|---|---|
| 1000: Evaporator | |
| 100: First header tank | |
| 100a: First compartment | 100b: Second compartment |
| 100c: Flow part | |
| 110: Header | 111: Barrier rib |
| 112: Tube insertion hole | 113: Baffle fixed groove |
| 120: Tank | 121: Depressed part |
| 122: First communication hole | 123: Second communication hole |
| 124: First fixed groove | 125: Second fixed groove |
| L1, L2: Lengths of a pair of second fixed grooves | |
| 126: Guide part | |
| 127: Protruded bead | |
| 130: Baffle | 131: First protruded part |
| 132: Second protruded part | 133: Temporarily assembled part |
| 134: Barrier rib insertion part | 135: Insertion fastening part |
| 140: Flow part forming member | 141: Extension |
| 150: End cap | 151: Plate part |
| 151a: Support part | |
| 152: First hollow hole | 153: Second hollow hole |
| 154: Third hollow hole | |
| 200: Second header tank | |
| 200a: First compartment | 200b: Second compartment |
| 300: Tube | |
| 400: Pin | |
| 510: First inlet | 520: Outlet |
| 530: Second inlet | |
| A1-1: 1-1-th region | A1-2: 1-2-th region |
| A2-1: 2-1-th region | A2-2: 2-2-th region |

DETAILED DESCRIPTION OF EMBODIMENTS

Hereinafter, an evaporator 1000 according to the present disclosure having the above-mentioned characteristics will be described in more detail with reference to the accompanying drawings.

The evaporator 1000 according to the present invention is a double evaporator 1000 that includes a first header tank 100, a second header tank 200, a tube 300, and a pin 400, forms a first column and a second column, and has a refrigerant flow in the first column and the second column, respectively.

First, the first header tank 100 and the second header tank 200 are formed in parallel with each other, being spaced apart from each other by a predetermined distance, have a space in which a refrigerant flows, and fix both ends of the tube 300, respectively.

The first header tank 100 and the second header tank 200 include at least one baffle 130 that is partitioned by a barrier rib 111 to form a first column and a second column to partition each of the first compartments 100*a* and 200*a* and the second compartments 100*b* and 200*b* in a width direction and partitions a space in a length direction.

The baffle 130 is configured to partition an interior space of the first compartments 100*a* and 200*a* and the second compartments 100*b* and 200*b* in a length direction to control a refrigerant flow therein.

The tube 300 of which both ends are fixed to the first header tank 100 and the second header tank 200 defines a space in which a refrigerant flows and the tube 300 forms two columns, including a column that communicates with the first compartments 100*a* and 200*a* of the first header tank 100 and the second header tank 200 to form a first column and a column that communicates with the second compartments 100*b* and 200*b* of the first header tank 100 and the second header tank 200 to form a second column.

The pin 400 is interposed between the tubes 300.

In the evaporator 1000 according to the present invention, the first header tank 100 is configured to include a header 110, a tank 120 formed with a depressed part 121, and a flow part forming member 140.

The header 110 is provided with a tube insertion hole 112 into which the tube 300 is inserted and is coupled with the tank 120 to form the first compartment 100*a* and the second compartment 100*b* therein.

In the tank 120, the depressed part 121 of which the central region formed with the barrier rib 111 is depressed is lengthily formed in a length direction.

The flow part forming member 140 is provided to cover the depressed part 121 of the tank 120 and is configured to form the flow part 100*c* in which a refrigerant flows, separately from the first compartment 100*a* and the second compartment 100*b*.

That is, the flow part forming member 140 is configured to be coupled with the tank 120 and defines the space of the flow part 100*c* at a position depressed by the depressed part 121, and components forming the first header tank 100 are temporarily assembled and then may be integrally formed by a final brazing process.

Hereinafter, the first header tank 100 is provided with the flow part 100*c* and the assembly structure to more improve productivity and durability of the baffle 130, the header 110, the tank 120, and the flow part forming member 140 will be described in detail.

First, the header 110 may be fixed by forming a baffle fixed groove 113 and protruding an insertion fastening part 135 corresponding to the baffle fixed groove 113.

In this case, in order to more clear the fixed position of the baffle 130 and more increase the fixing force with the tank 120, in the evaporator 1000 according to the present invention, a first fixed groove 124 may be formed at the depressed part 121 of the first header tank 100 and the baffle 130 may be formed with a first protruded part 131 that is inserted into the first fixed groove 124.

The first fixed groove 124 is a portion at which a predetermined region of the central region formed with the barrier rib 111 in the depressed part 121 forming region of the tank 120 is hollowed in a width direction.

As the first fixed groove 124 is formed in the central region of the depressed part 121 formed with the barrier rib 111, the baffle 130 is integrally formed so as to partition the first compartment 100*a* and the second compartment 100*b* in a length direction and is provided with the first protruded part 131 corresponding to the first fixed groove 124.

In this case, the baffle 130 is integrally formed to partition the first compartment 100*a* and the second compartment 100*b* in a length direction and the baffle 130 may be formed with a barrier rib inserting part 134 that inserts the barrier rib 111 into the baffle 130.

That is, the baffle 130 is formed to correspond to a size of the first compartment 100*a* and the second compartment 100*b* to partition the first compartment 100*a* and the second compartment 100*b* in a width direction and a length direction.

Further, the evaporator 1000 according to the present invention, the first header tank 100 may be provided with the pair of second fixed grooves 124 in which the predetermined region of the tank 120 forming the first compartment 100*a* and the second compartment 100*b*, respectively, is hollowed, and the baffle 130 may be provided with the pair of second protruded parts 132 that is inserted into the pair of second fixed grooves 125, respectively.

The second protruded part 132 makes the fixed position of the baffle 130 accurate along with the first protruded part 131 formed in the baffle 130 and expands the bonded region, thereby more increasing the durability.

In this case, since lengths L1 and L2 of the pair of second fixed grooves 125 are formed differently in a width direction, the first header tank 100 may prevent the flow part forming member 140 from misassembling in other directions.

Figure 10:
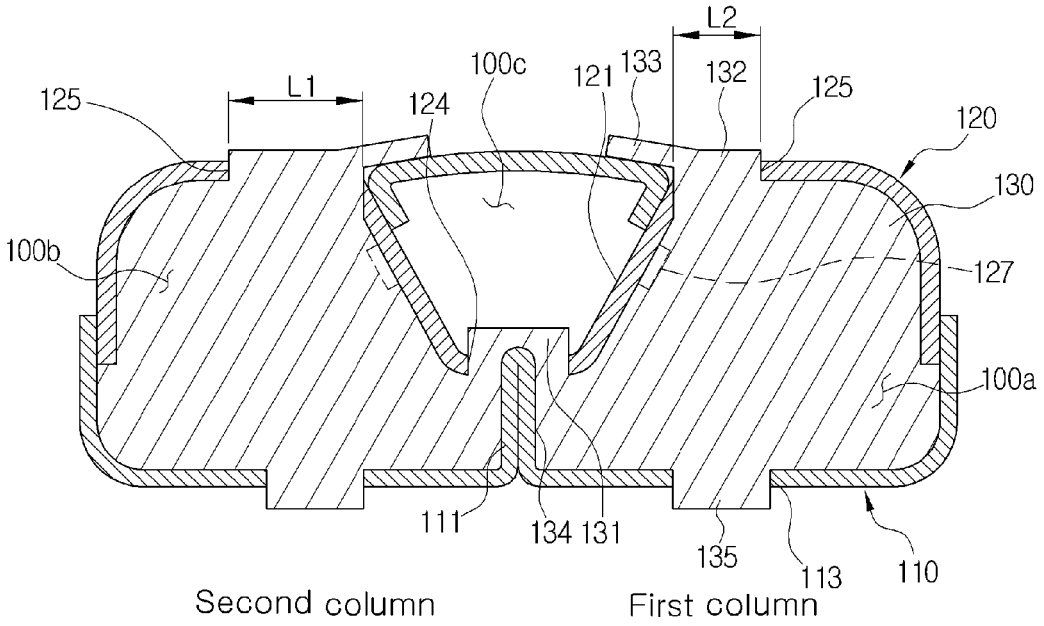
FIG. 10 is another cross-sectional view of a first header tank of the evaporator according to the present invention.

As illustrated in FIG. 10, the length L1 of the second fixed groove 125 of one portion is formed in a width direction to be longer than the length L2 of the second fixed groove 125 of the other portion, such that the flow part forming member 140 is assembled in a specific direction and is not assembled in other directions.

In FIG. 10, the lengths of the pair of second fixed grooves 125 are each represented by reference numerals L1 and L2.

Further, in the evaporator 1000 according to the present invention, the second protruded part may be further provided with a temporarily assembled part 133 so as to keep the temporarily assembled state of the flow part forming member 140.

That is, the baffle 130 may be further provided with the temporarily assembled part 133 folded to the flow part forming member 140, in which a predetermined region of the second protruded part 132 extends in a lateral direction (a direction in which the second protruded part 132 is inserted into the second fixed groove 125).

Figure 5A:
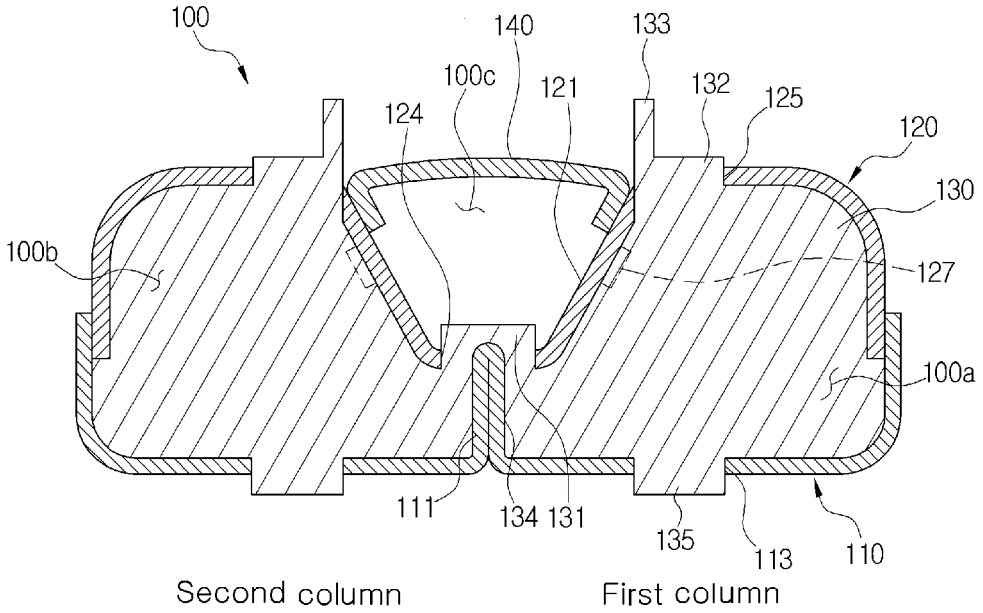
Figure 5B:
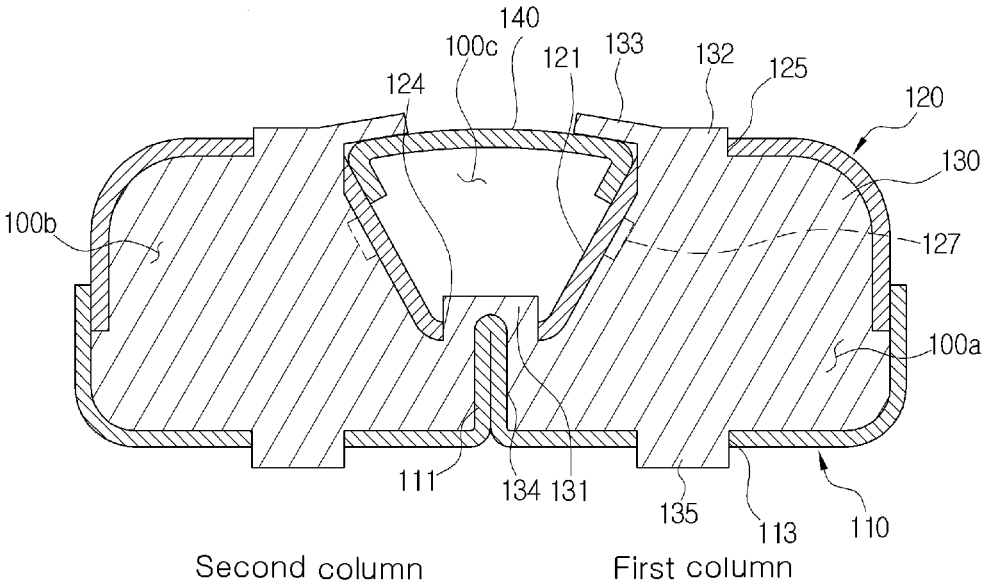

FIG. 5A illustrates the state in which the baffle 130 is inserted so that the first protruded part 131 and the second protruded part 132 each correspond to the first fixed groove 124 and the second fixed groove 125 of the tank 120, respectively. Next, as illustrated in FIG. 5B, a guide part 126 is folded to the flow part forming member 140 to keep the temporarily assembled state of the flow part forming member 140, and is brazing coupled in this state, thereby manufacturing the evaporator 1000.

That is, in the first header tank 100, the second protruded part 132 of the baffle 130 is disposed in the inner space (the first compartment 100*a* and the second compartment 100*b*) formed by the tank 120 and the header 110. The first header tank 100 is protruded to the outer side of the tank through the second fixed groove 125 of the tank 120, and the temporarily assembled part 133 extending to the second protruded part 132 is folded to the flow part forming member 140 to keep in the state in which the flow part forming member 140 is assembled in the tank before the brazing process is performed, thereby more increasing productivity by a simple method without the separate fixed jig.

Figure 6:
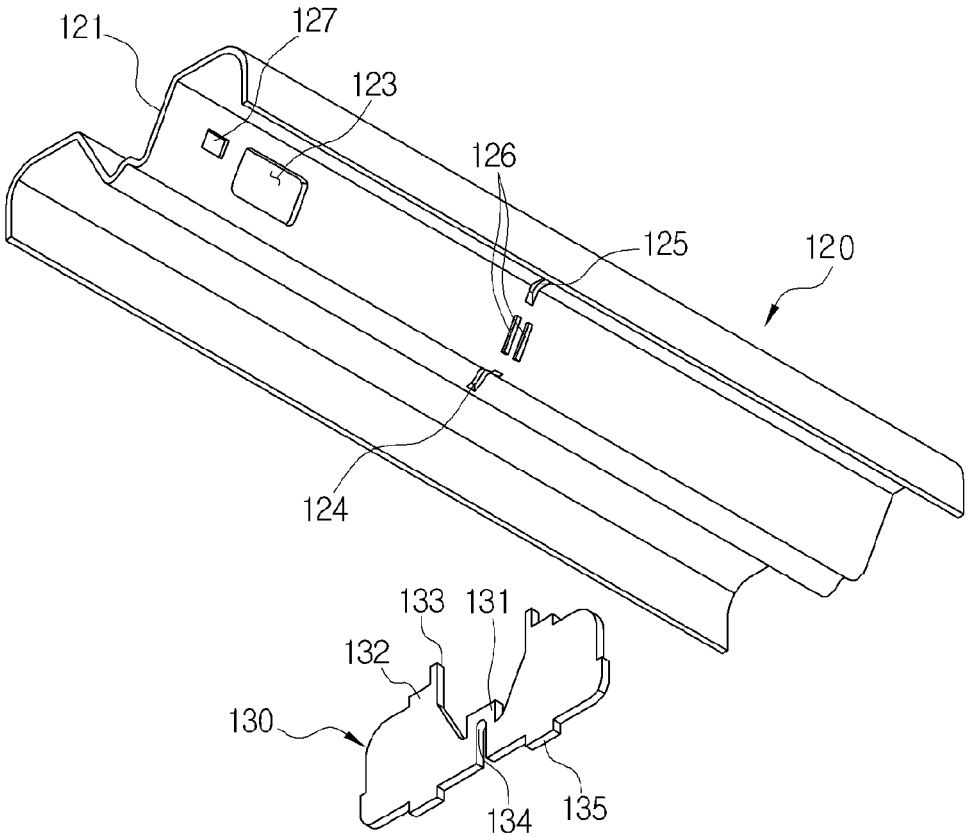
FIG. 6 is a partial perspective view in a tank of the evaporator according to the present invention.

In addition, as illustrated in FIG. 6, in the evaporator 1000 according to the present invention, the depressed part 121 of the tank 120 may be further provided with the pair of guide parts 126 that is protruded to the first compartment 100*a* or the second compartment 100*b* to support the baffle 130.

That is, the guide parts 126 may more increase the fixing force of the baffle 130, such that in the evaporator 1000 according to the present invention, the defective rate due to the non-bonding of the baffle 130 and the portion of the tank 120 can be remarkably reduced, thereby more increasing the productivity.

In this case, in the tank 120 of the first header tank 100, the depressed part 121 may be provided with at least one first protruded bead 124 that is protruded to the flow part 100*c* to support the flow part forming member 140.

The protruded bead 127 may support the flow part forming member 140 to determine the assembly depth of the flow part forming member 140 in a height direction.

Further, the flow part forming member 140 may be provided with extensions 141 that extend to contact at least two of the surfaces of the first protruded beads 124 vertically to the length direction of the first header tank 100.

That is, the extensions 141 of the flow part forming member 160 may be adhered to at least two protruded beads 124 to prevent the flow part forming member 140 from moving in a length direction and accurately keep the assembly position.

Figure 7:
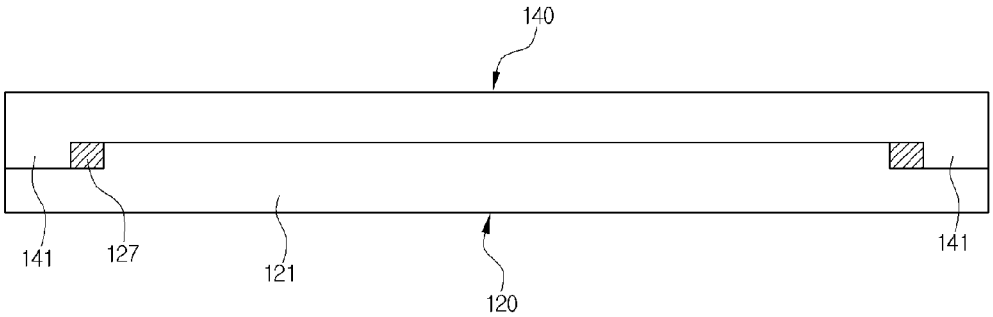
FIG. 7 is a plan view of the evaporator according to the present invention.

FIG. 7 illustrates an example in which the protruded bead 127 is disposed at two places in a length direction, and the extensions 141 protruded to the first protruded beads 124 are each disposed at both ends of the flow part forming member 140.

Figure 8A:
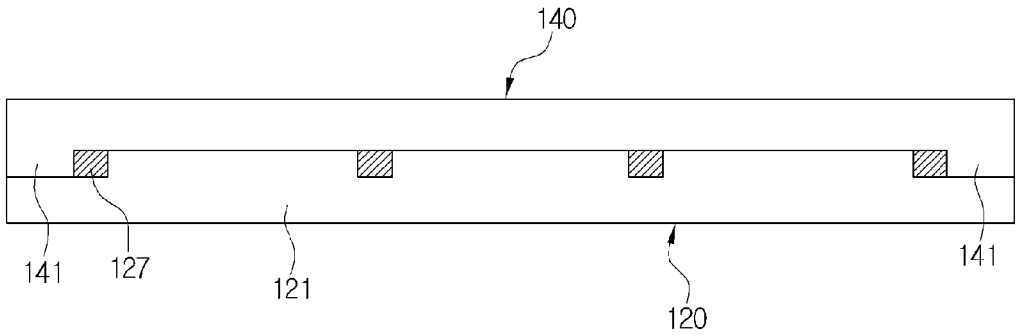
FIG. 8A to 8C are a diagram illustrating various exemplary embodiments of a flow part forming member and a protruded bead of the evaporator according to the present invention.
Figure 8B:
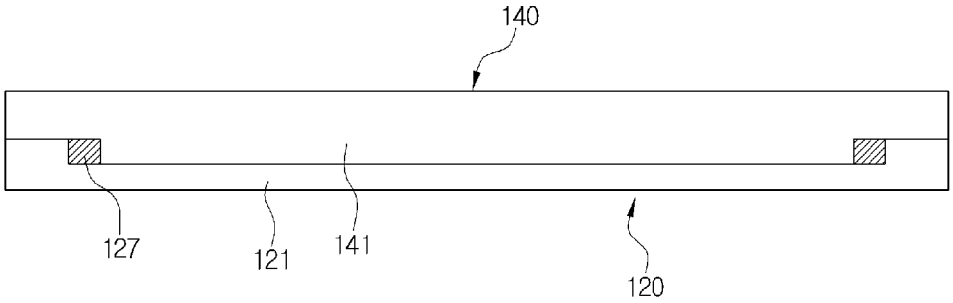
Figure 8C:
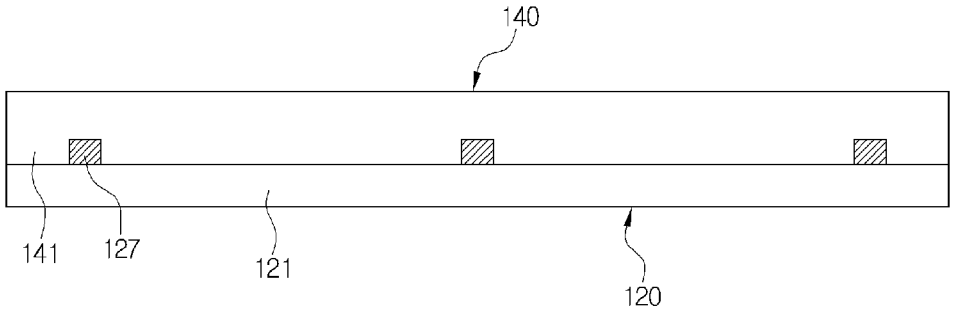

FIGS. 8A-8C illustrate various embodiments of the protruded beads 127 and the flow part forming member 140. In particular, FIG. 8A illustrates an example similar to the example illustrated in FIG. 7, but an example in which four protruded beads 127 are formed in a length direction.

In addition, FIG. 8B illustrates an example in which the protruded bead 127 is disposed at two places in a length direction and one extension 141 is formed so that the flow part forming member 140 corresponds to a region between the protruded beads 127, and FIG. 8C illustrates an example in which the first protruded bead 127 is disposed at three places in a length direction and the extension 141 is formed so as to correspond to both ends of the flow part forming member 140 and the region between the first protruded beads 127.

In addition to the examples illustrated in the drawings, in the evaporator 1000 according to the present invention, the number and shape of protruded beads 127 may be formed more variously and the extension 141 may also be formed more variously.

The evaporator 1000 according to the present invention may have more improved durability by forming the first protruded bead 127 in the depressed part 121 and may have more improved assembly performance by using the flow part forming member 140 formed with the extension 141 to stably keep the temporarily assembled state of the flow part forming member 140 at an accurate position prior to the brazing process.

A plate part 151 of the end cap 150 has a plate shape to block both ends of the first header tank 100, and is provided with a structure to be easily coupled with an inner circumferential surface or an outer circumferential surface of the first header tank 100.

The evaporator 1000 according to the present invention may have a structure in which the end cap 150 is provided with the plate part 151 and a support part 151*a*.

In this case, the end cap 150 may be formed with the support part 151*a* that is protruded in a form in which a predetermined region of the plate part 151 corresponds to the space of the flow part 100*c* to support the flow part forming member 140.

That is, the support part 151*a* is configured to support the flow part forming member 140 along with the protruded bead 127 formed in the depressed part 121, and both ends of the flow part forming member 140 are supported by the end cap 150 and an inner side portion of the flow part forming member 140 is supported by the support part 151*a* to prevent the flow part forming member 140 from moving, including the width direction and the height direction, and widen a welding region, thereby more increasing the durability.

Figure 9:
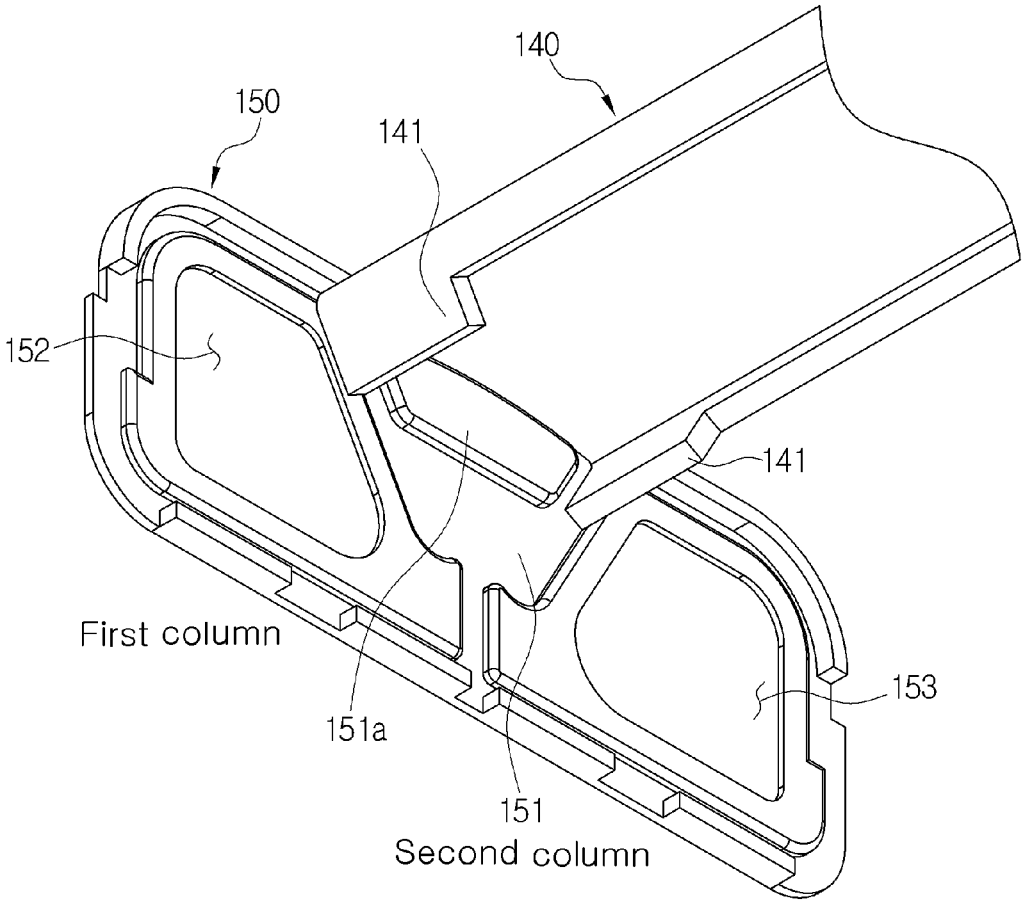
FIG. 9 is a diagram illustrating in detail a cap of the evaporator according to the present invention.

Further, one of the end caps 150 disposed at both ends of the first header tank 100 is provided with a first hollow hole 152 and a second hollow hole 153. (See FIG. 9, which illustrates the end cap 150 that is shown in the left of FIG. 4).

Figure 4:
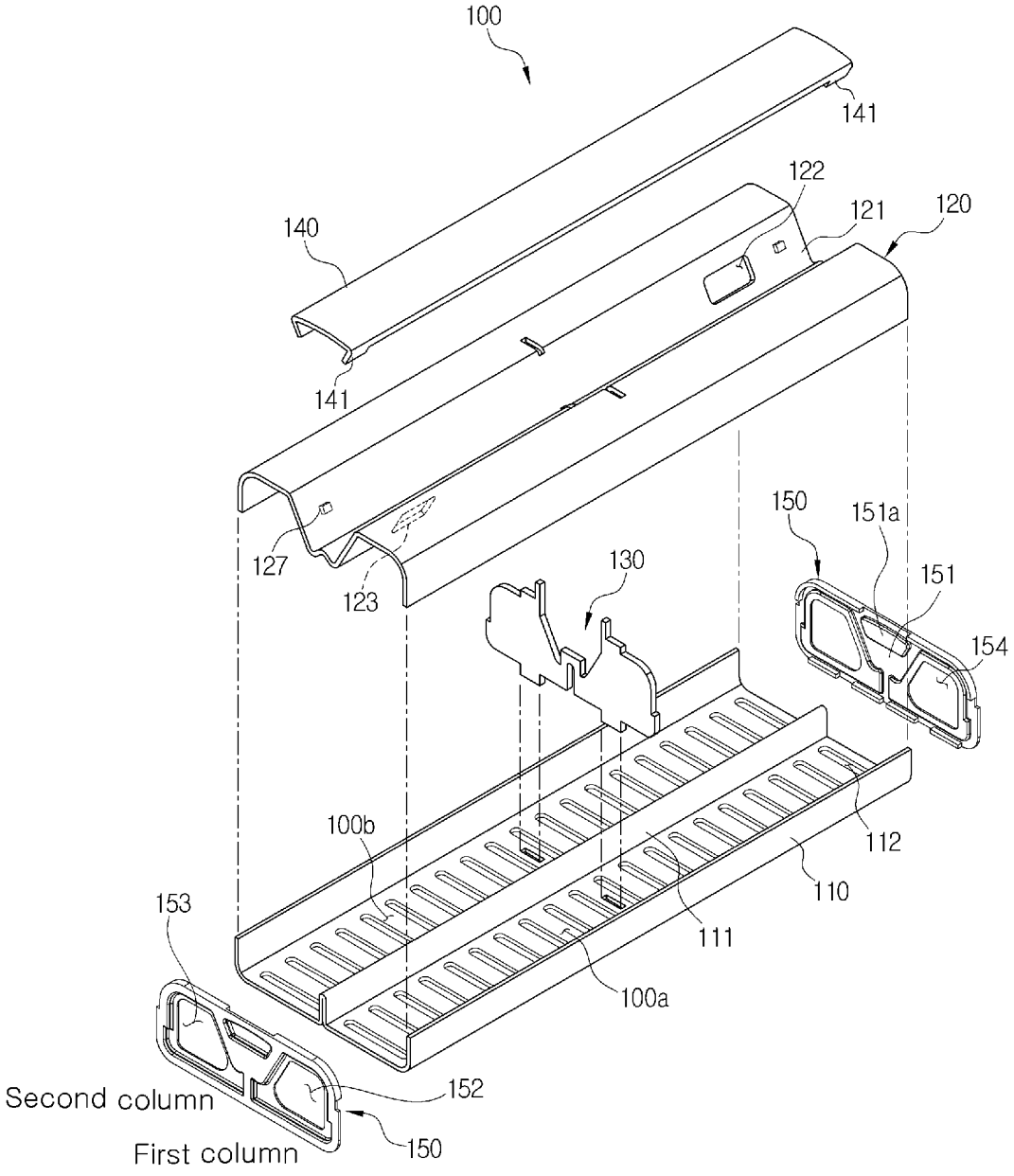

FIG. 4 illustrates an example in which the end cap 150, in which the first hollow hole 152 and the second hollow hole 153 are formed, is positioned at the left, and an example in which the first hollow hole 152 communicates with the outlet 520, and the second hollow hole 153 communicates with the second inlet 530.

In addition, in FIG. 4, the end cap 150 closing the right portion of the first header tank 100 is provided with a third hollow hole 154 that communicates with the first inlet 510 by perforating a predetermined region corresponding to the first compartment 100*a*.

In more detail, the first hollow hole 152 and the second hollow hole 153 are disposed at one of a pair of the end caps 150 that is disposed at both ends of the first header tank 100, and the first hollow hole 152 is a portion in which the predetermined region corresponding to the first compartment 100*a* in the predetermined region of the plate part 151 is hollowed, and the second hollow hole 153 is a portion in which the predetermined region corresponding to the second compartment 100*b* in the predetermined region of the plate part 151 is hollowed.

Further, the third hollow hole 154 is disposed at the remaining one of the pair of end caps 150 that is disposed at both ends of the first header tank 100, and the third hollow hole 154 is a portion in which the predetermined region corresponding to the first compartment 100*a* in the predetermined region of the plate part 151 is hollowed.

A portion of the end cap 150 (end cap 150 as illustrated at the right side of FIG. 4) formed with the third hollow hole 154 that corresponds to the second compartment 100*b* is in a closed state. That is, the end cap 150 closes one portion of the second compartment 100*b* as shown in FIG. 4, and the refrigerant introduced into the second compartment 100*b* through the second inlet 530 moves to the flow part 100*c* through the first communication hole 122. The detailed refrigerant flows will be described below.

Further, the tank 120 of the first header tank 100 may be inclined to the barrier rib 111 so that the depressed part 121 has a "Y"-letter shape along with the barrier rib 111.

As a result, the evaporator 1000 according to the present invention may make the refrigerant flow smoother in the first compartment 100*a*, the second compartment 100*b*, and the flow part 100*c* that are included in the first header tank 100 and may sufficiently secure the formation area of the first communication hole 122 through which the second compartment 100*b* and the flow part 100*c* communicate with each other and the second communication hole 123 through which the first compartment 100*a* and the flow part 100*c* communicate with each other.

When the depressed part 121 of the first header tank 100 forms a "Y"-letter shape along with the barrier rib 111, the formation space of the flow part 100*c* is also formed to correspond thereto.

The second header tank 200 may be formed by a coupling of the header and the tank and in addition to this, when the second header tank 200 has a structure in which the first compartment 200*a* and the second compartment 200*b* are partitioned in a width direction by the barrier rib, and includes the baffle 130 disposed therein to regulate the refrigerant flow, the second header tank 130 may be more variously formed.

In addition, in the evaporator 1000 according to the present invention, the first header tank 100 may include a first inlet 510, an outlet 520, and a second inlet 530.

In more detail, the first inlet 510 is connected with one portion of the first compartment 100*a* of the first header tank 100, the outlet 520 is connected with the other portion of the first compartment 100*a* of the first header tank 100, and the second inlet 530 is connected with the other portion of the second compartment 100*b* of the first header tank 100.

In addition, in the tank 120 of the first header tank 100, the depressed part 121 is provided with the first communication hole 122 adjacent to the first inlet 510 forming region in a length direction to communicate the second compartment 100*b* with the flow part 100*c*, and a second communication hole 123 adjacent to the outlet part 520 and the second inlet part 530 forming region to communicate the first barrier rib 100*a* with the flow part 100*c*.

The evaporator 1000 according to the present invention includes, in the first column, a 1-1-th region A1-1 where the refrigerant introduced into the first compartment 100*a* of the first header tank 100 through the first inlet 510 moves to the first compartment 200*a* of the second header tank 200 through the tube 300, and a 1-2-th region A1-2 in which the refrigerant of the first compartment 200*a* of the second header tank 200 moves to the first compartment 100*a* of the first header tank 100 through the tube 300, and in second column, a 2-1-th region in which the refrigerant introduced into the second compartment 100*b* of the first header tank 100 through the second inlet 530 moves to the second compartment 200*b* of the second header tank 200 through the tube 300, and a 2-2-th region in which the refrigerant of the second compartment 200*b* of the second header tank 200 moves to the second compartment 100*b* of the first header tank 100 through the tube 300, in which the refrigerant passing through both of the 2-1-th region A2-1 and the 2-2-th region A2-2 of the second column moves to the flow part 100*c* through the first communication hole 122 and moves in a length direction and is joined with the refrigerant discharged through the 1-1-th region A1-1 and the 1-2-th A1-2 of the first column through the second communication hole 123 to be discharged through the outlet 520.

That is, the flow part 100*c* of the first header tank 100 is a space in which the refrigerant passing through the inside of the second column moves and flows, and the refrigerant passing through the space of the flow part 100*c* is joined with the refrigerant passing through the inside of the first column, which is in turn discharged.

As a result, in the case in which the evaporator 1000 according to the present invention has the double evaporation structure of the first column and the second column, the outlet 520 may be integrated and thus the number of connection pipe lines may be more reduced, such that the evaporator 1000 may be miniaturized.

Figure 11:
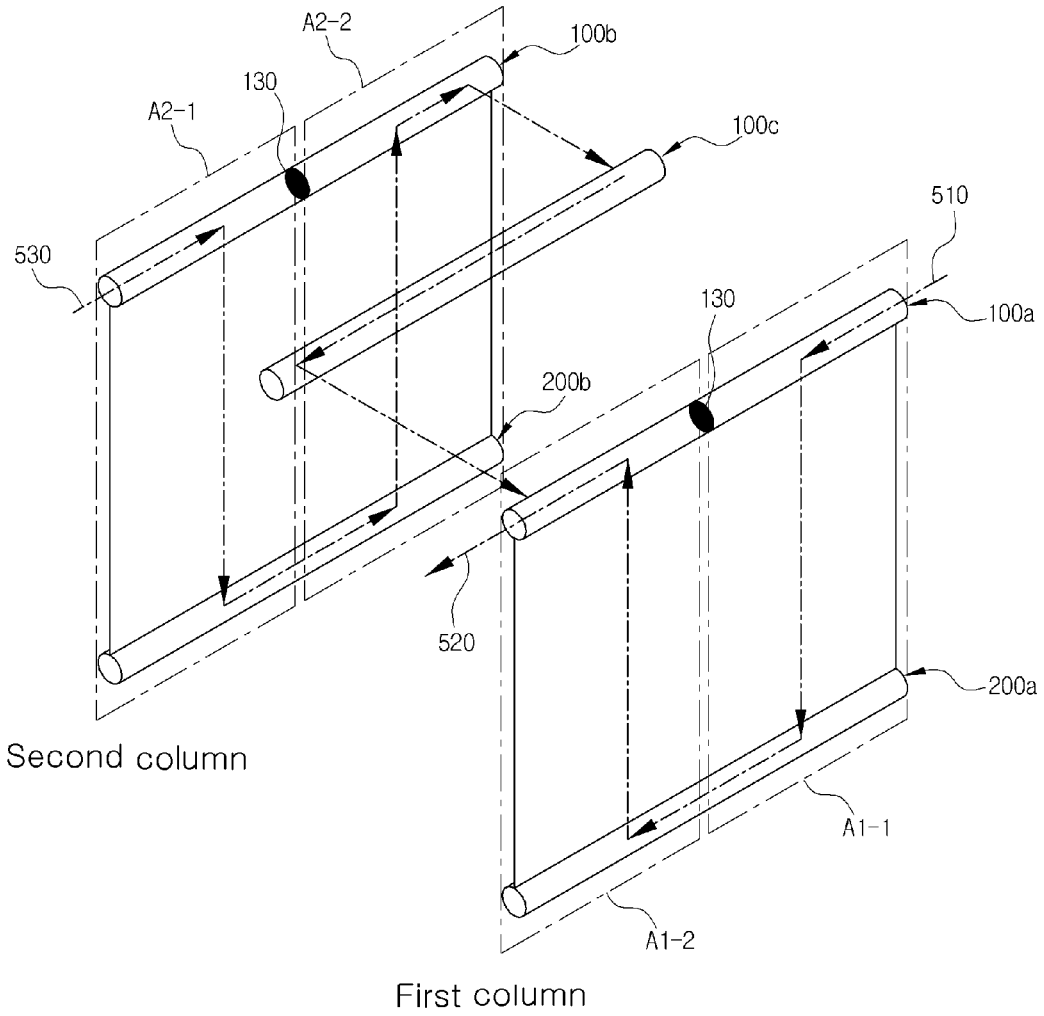
FIGS. 11 and 12 are diagrams illustrating a refrigerant flow of the evaporator according to the present invention.
Figure 12:
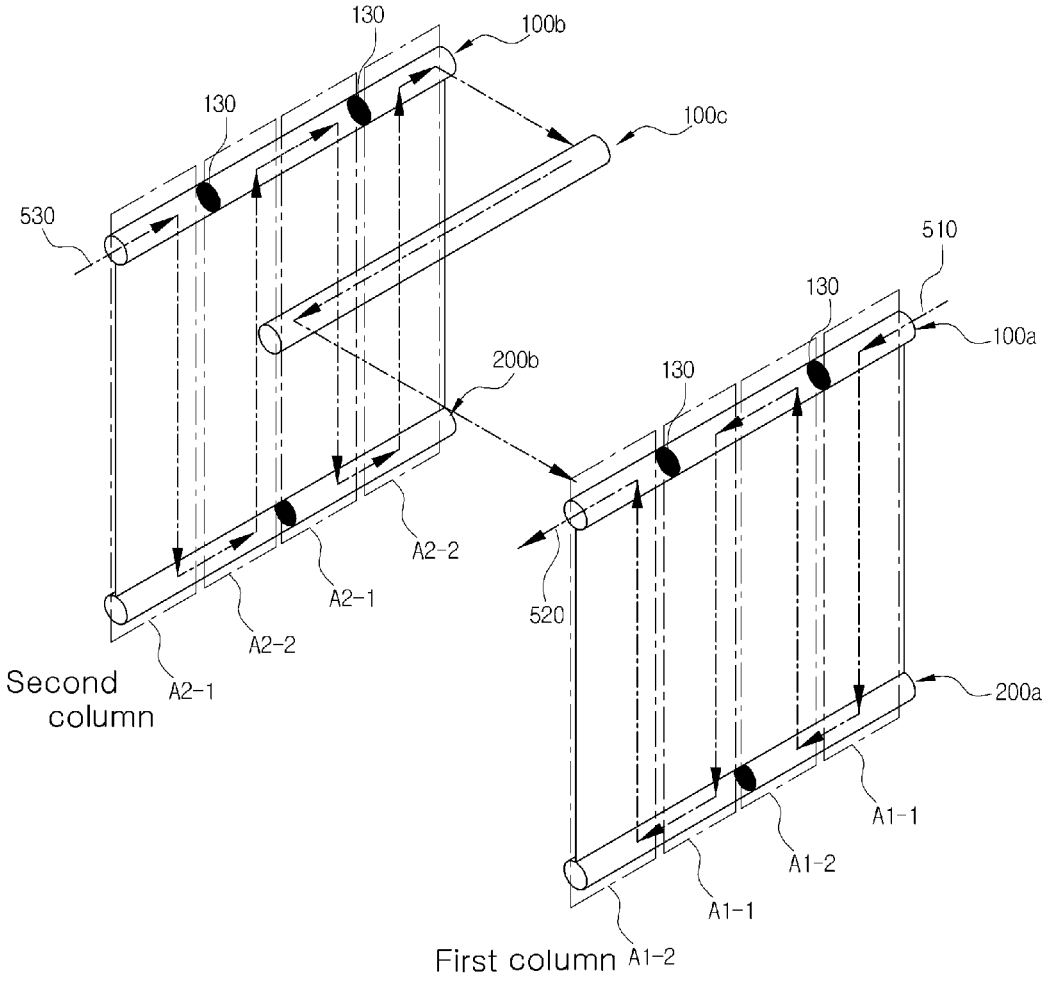

FIGS. 11 and 12 are diagrams illustrating the detailed refrigerant flow of the evaporator 1000 according to the present invention, and FIG. 11 illustrates a flow in which the 1-1-th region A1-1 and the 1-2-th region A1-2 are each formed once and the 2-1-th region and the 2-2-th region A2-2 are each formed once.

In more detail, in the first column of FIG. 11, the refrigerant introduced through the first inlet 510 is discharged through the outlet 520 via the 1-1-th A1-1 (top→bottom)—the 1-2-th region A1-2 (bottom→top) and in the second column, the refrigerant introduced through the second inlet 530 moves to the 2-1-th region A2-1 (top→bottom)—the 2-2-th region A2-2 (bottom→top) and moves to the flow part 100*c* through the first communication hole 122, and is then discharged along with the refrigerant passing through the first column through the outlet 520 connected with the first column through the second communication hole 123.

Further, FIG. 12 illustrates a flow in which the 1-1-th region A-1 and the 1-2-th region A1-2 are each formed twice, and the 2-1-th region and the 2-2-th region A2-2 are each formed twice.

In more detail, in the first column of FIG. 12, the refrigerant introduced through the first inlet 510 is discharged through the outlet 520 via the 1-1-th A1-1 (top→bottom)—the 1-2-th region A1-2 (bottom→top)—the 1-1-the region A1-1 (top→bottom)—the 1-2-th region (bottom→top), and in the second column, the refrigerant introduced through the second inlet 530 moves to the 2-1-th region A2-1 (top→bottom)—the 2-2-th region A2-2 (bottom→top)—the 2-1-th region A2-1 (top→bottom)—the 2-2t-th region A2-2 (bottom→top) and moves to the flow part 100*c* through the first communication hole 122, and is then discharged along with the refrigerant passing through the first column through the outlet 520 connected with the first column through the second communication hole 123.

In FIGS. 11 and 12, the tank 120 and the header 110 disposed at the upper portion are illustrated as the first header tank 100, and the tank 120 and the header 110 disposed at the lower portion are illustrated as the second header tank 200, but the evaporator 1000 according to the present invention is not limited thereto and the inner refrigerant flow may be more variously formed according to the formation position and number of baffles 130, the formation position of the first inlet 510, the outlet 520, and the second inlet 530, and the like.

The present invention relates to the double evaporator 1000 in which the refrigerant flows in the first column and the second column, respectively, in which the refrigerant channel structure may be improved by forming the depressed part 121 in the tank 120 and by forming the flow part 100*c* having the refrigerant flow therein using the flow part forming member 140, separately the first compartment 100*a* and the second compartment 100*b*, such that each of the first column and the second column is provided with the inlet and the outlet 520, thereby reducing the total number of inlets and outlets that are disposed in the first column and the second column, respectively, simplifying the assembly process to improve the production efficiency, and implementing the miniaturization.

According to the present invention, the evaporator includes the tank formed with the depressed part and the flow part having a refrigerant flow therein using the flow part forming member, separately from the first compartment and the second compartment to improve the refrigerant channel structure. In the double evaporator, the refrigerant flows in the first column and the second column, respectively, thereby reducing the number of inlets and outlets that are disposed in the first column and the second column, respectively.

Therefore, the evaporator according to the present invention can reduce the number of components and simplify the assembly process to improve the production efficiency and reduce the number of outlets as compared with the related art to more reduce the number of connection pipe lines, thereby realizing the miniaturization.

Further, according to the evaporator of the present invention, the first fixed groove is formed at the tank depressed part, the first protruded part corresponding to the first fixed groove is formed at the baffle, the second fixed groove is formed at the tank, and the second protruded part corresponding to the second fixed grooved is formed at the baffle, thereby fixing the baffle at the accurate position and reducing the defective rate to more improve the productivity.

In addition, according to the evaporator of the present invention, the predetermined region of the second protruded part is protruded, and the temporarily assembled part folded to the flow part forming member is formed to keep the state in which the flow part forming member is assembled in the tank before the brazing process is performed, thereby more improving the productivity by a simple method without the separate fixing jig.

Also, according to the evaporator of the present invention, the pair of second fixed grooves are formed to have different lengths in a width direction, thereby preventing the flow part forming member from misassembling.

Further, according to the evaporator of the present invention, the protruded bead is formed in the depressed part to support the flow part forming member and the extension is formed in the flow part forming part to accurately assemble the flow part forming member to meet a design specification and fix the flow part forming member prior to the brazing forming process, thereby increasing the productivity and quality.

In addition, according to the evaporator of the present invention, the end cap formed with the support part is formed to stably fix the flow part forming member prior to the brazing forming process, thereby more increasing the durability and facilitating the formation of the inlet and the outlet.

Moreover, according to the evaporator of the present invention, the depressed part is inclined to form the "Y"-letter shape along with the barrier rib, thereby smoothing the refrigerant flow in the first compartment, the second compartment, and the flow part, and sufficiently securing the formed area of the first communication hole and the second communication hole through which the flow part communicates with the second compartment and the first compartment.

The present invention is not limited to the above-mentioned exemplary embodiments, and may be variously applied, and may be variously modified without departing from the gist of the present invention claimed in the claims.

What is claimed is:

1. An evaporator, comprising:

a first header tank and a second header tank disposed in parallel with each other, being spaced apart from each other by a predetermined distance and including at least one baffle that is partitioned by a barrier rib to form a first column and a second column to partition each of a first compartment and a second compartment in a width direction and partition a space in a length direction; and a plurality of tubes, each of which having both ends fixed to the first header tank and the second header tank; and a pin interposed between the plurality of tubes, wherein the first header tank includes a header, a tank having a depressed part disposed at a central region of the tank in a length direction and in correspondence with the barrier rib, and a flow part forming member that is disposed to cover the depressed part of the tank and to form a flow part disposed therein to have a refrigerant flow therein, separately from the first compartment and the second compartment.

2. The evaporator of claim 1, wherein, in the first header tank, the central region of the depressed part at which the barrier rib is disposed includes a first fixed groove which is hollowed in the width direction and disposed in a predetermined region, and the baffle is integrally formed in a width direction to partition the first compartment and the second compartment in the length direction and a first protruded part inserted into the first fixed groove is protruded.

3. The evaporator of claim 1, wherein the first header tank includes a pair of second fixed grooves which is disposed at a predetermined region of the tank forming the first compartment and the second compartment, respectively, and is hollowed in the width direction, and the baffle includes second protruded parts that are inserted into the pair of second fixed grooves, respectively.

4. The evaporator of claim 3, wherein the first header tank includes the pair of second fixed grooves to have different lengths in the width direction.

5. The evaporator of claim 3, wherein, in the first header tank, a predetermined region of the second protruded part of the baffle extends in a lateral direction, and a temporarily assembled part keeping a state in which the flow part forming member is temporarily assembled, is provided.

6. The evaporator of claim 1, wherein, in the first header tank, the depressed part further includes a pair of guide parts protruded to the first compartment or the second compartment to support the baffle.

7. The evaporator of claim 1, wherein the tank of the first header tank is inclined to the barrier rib so that the depressed part has a "Y"-letter shape along with the barrier rib.

8. The evaporator of claim 5, wherein both ends of the first header tank are provided with an end cap including a plate part and a support part that is protruded in a form in which a predetermined region of the plate part corresponds to a space of the flow part to support the flow part forming member.

9. The evaporator of claim 8, wherein one of the end caps disposed at both ends of the first header tank includes a first hollow hole of which a predetermined region corresponding to the first compartment in the predetermined region of the plate part is hollowed and a second hollow hole of which a predetermined region corresponding to the second compartment in the predetermined region of the plate part is hollowed, and the other one of the end caps includes a third hollow hole of which a predetermined region corresponding to the first compartment in the predetermined region of the plate part is hollowed.

10. The evaporator of claim 1, wherein the first header tank includes:

a first inlet connected with one portion of the first compartment to introduce a refrigerant;

an outlet connected with another portion of the first compartment to discharge the refrigerant; and a second inlet connected with one portion of the second compartment to be introduce the refrigerant.

11. The evaporator of claim 10, wherein, in the tank of the first header tank, the depressed part includes a first communication hole that is adjacent to a formation region of the first inlet in the length direction to communicate the second compartment with the flow part and a second communication hole that is adjacent to a formation region of the outlet and the second inlet in a length direction to communicate the first compartment with the flow part.

12. The evaporator of claim 11, further comprising:

a first region disposed in the first column, wherein the refrigerant introduced into the first compartment of the first header tank through the first inlet moves to the first compartment of the second header tank through at least one of the plurality of tubes and a second region in which the refrigerant of the first compartment of the second header tank moves to the first compartment of the first header tank through at least one of the plurality of tubes; and a third region disposed in the second column in which the refrigerant introduced into the second compartment of the first header tank through the second inlet moves to the second compartment of the second header tank through at least one of the plurality of tubes and a fourth region in which the refrigerant of the second compartment of the second header tank moves to the second compartment of the first header tank through at least one of the plurality of tubes, wherein the refrigerant passing through both of the third region and the fourth region of the second column moves to the flow part through the first communication hole and moves in the length direction and is joined with the refrigerant discharged through the first region and the second region of the first column through the second communication hole to be discharged through the outlet.

* * * * *